United States Patent [19]

Jewett

[11] 4,030,147

[45] June 21, 1977

[54] POOL DIVER SAFETY AND RESEARCH APPARATUS

[76] Inventor: Harold A. Jewett, 5451 42nd St., NW., Washington, D.C. 20015

[22] Filed: July 14, 1976

[21] Appl. No.: 705,298

Related U.S. Application Data

[60] Division of Ser. No. 620,143, Oct. 6, 1975, Pat. No. 3,997,924, which is a continuation-in-part of Ser. No. 596,173, July 15, 1975, Pat. No. 3,956,779.

[52] U.S. Cl. ..... 4/172; 272/1 B; 272/71

[51] Int. Cl.[2] ..... E04H 3/16; E04H 3/18; F16L 22/02

[58] Field of Search ..... 4/172, 172.19, 172.21; 272/66, 65, 1 B, 1, 56.5 R, 71; 9/311, 312, 313

[56] References Cited

UNITED STATES PATENTS

| | | | |
|---|---|---|---|
| 2,042,152 | 5/1936 | Howland | 9/311 |
| 3,000,017 | 9/1961 | Skovira | 4/172.13 |
| 3,091,777 | 6/1963 | Pearlson | 4/172.13 |
| 3,123,845 | 3/1964 | Girden | 9/311 |
| 3,183,530 | 5/1965 | Girden | 9/311 |
| 3,429,085 | 2/1969 | Stillman, Jr. | 4/172 X |
| 3,644,941 | 2/1972 | Kuss | 4/172.12 |
| 3,660,957 | 5/1972 | Schankler | 4/172.19 X |
| 3,780,385 | 12/1973 | Dunn | 4/172.13 |
| 3,942,198 | 3/1976 | Jewett | 4/172 |
| 3,956,779 | 5/1976 | Jewett | 4/172 |

*Primary Examiner*—Henry K. Artis

[57] ABSTRACT

A cable car or the like, operable by either muscular or electric power — e.g. by a stationary motor — is provided with a railway having a runway whose side walls serve to guide the car during travel along the runway, as well as with an abutment for abruptly ending said travel at the edge of a pool (automatic cut-off means being actuated just prior thereto), while a diver who has derived momentum from belly-down riding on top of the car is consequently propelled outwardly over the pool along whatever trajectory may have been pre-calculated. Although applicable to living divers at recreational pools, the invention is primarily useful for an unlimited range of diver tests via use of midget-size facsimilies of human divers, e.g. dolls readily available at store toy counters and having swivel joints internally frictionized so as to maintain the limbs and heads in any postures initially selected as well as to keep them there until subsequently changed, and wherein the arms can readily be rigidly maintained in straight-ahead or downwardly-dangling postures, as desired, by use of rigid splints. Desired body weight and/or density also can readily be achieved by appropriately dimensioned waistbands of thin sheet lead, plus desired locating of the center of gravity in the process.

10 Claims, 23 Drawing Figures

FIG. 12.
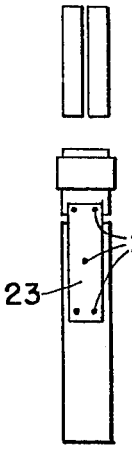
FIG. 13.
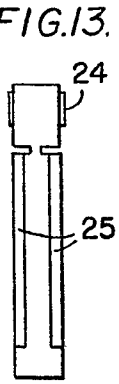
FIG. 14.
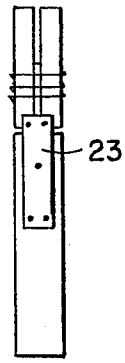
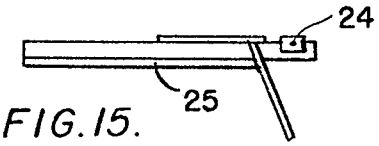
FIG. 15.
FIG. 16.
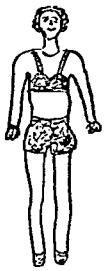
FIG. 17.
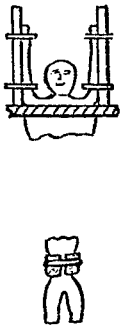
FIG. 18.
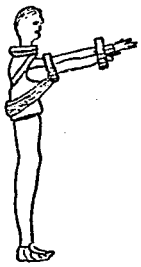
FIG. 19.
FIG. 20.
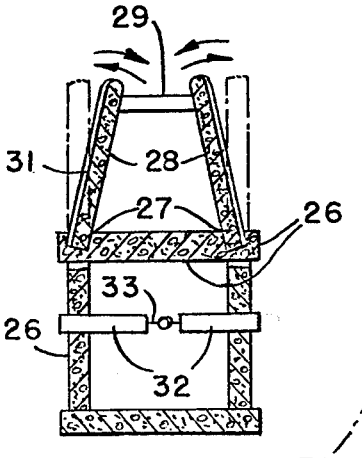
FIG. 21.
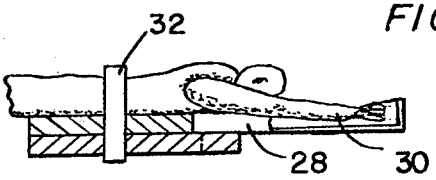
FIG. 22.
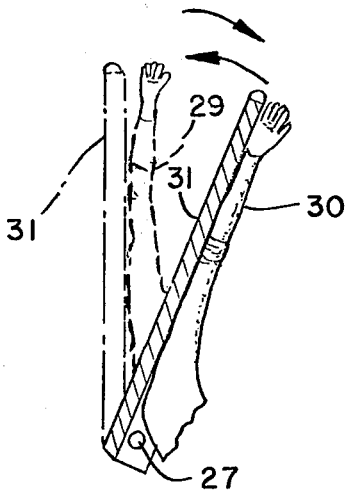
FIG. 23.
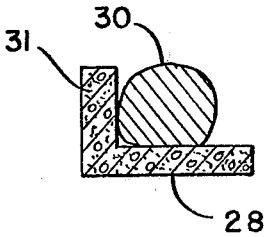

POOL DIVER SAFETY AND RESEARCH APPARATUS

This application is a division of application Ser. No. 620,143 filed Oct. 6, 1975 now U.S. Pat. No. 3,997,924 which was a continuation-in-part of Ser. No. 596,173 now U.S. Pat. No. 3,956,779, which was filed July 15, 1975 and is intended to be included herein by reference, and which, like said application Ser. No. 620,143, now U.S. Pat. No. 3,997,924 and this application, pertains to diver safety in swimming pools.

Applicant is unaware of relevant art other than that represented and discussed in the parent case, particularly in the paragraph bridging its pages 13–14, wherein the belief was expressed that "with merely a thin surface linear, a single lamina of flexible cushioning material adjacent thereto, and a stiffener lamina comprised only of Styrofoam," a single baffle — the baffles of said application having in fact been buoyantly supported safety flooring disposed closely suprajacent to the pool bottom, as exemplified in FIG. 1 thereof — might "crack or fracture, internally at least, under violent diver impact"; thereby serving, as regards present purposes, to break the fall of a diver or his head and thus save his life or skull.

In reviewing the records of extensive diving research conducted a few years ago at the University of Utah, and more recently at Nova University, Ft. Lauderdale, Fla., which records are on file in the Secretary's Office of the United States Consumer Product Safety Commission at 1750 K Street, N.W., Washington, D.C. as well, also, as the news items which appeared in issues of The Swimming Pool Weekly (and Swimming Pool Age) from time to time, both in regard thereto and to diving-hopper research conducted by Little and Co. at The Massachusetts Institute of Technology in recent years, it become apparent to applicant that a dire need existed for precision-fabricated pool divers of midget size so constructed as to be substantially perfect facsimilies of fullsized living divers, i.e. in all attributes of body configuration, specific gravity (e.g. slightly less than that of water), location of center of gravity (⅓ the distance from crotch to chin), movable joints internally frictionized so that mere manual urging would serve to impart to them any desired limb postures which might be retained until further such urging, and inclusive of swiveling of the head whether by rotation at the neck or up-down movement when in prone belly-down position; it being contemplated that such midgets, in assorted sizes, weights, width dimensions of calves, thighs, buttocks, abdomens and hips and shoulders, could be placed — belly-down — on the tops of roller cars at a deck-based end portion of a railway having side flanges defining the path of the rollers during use; so that the car could acquire any desired speed, whether by gravity, stationary motor, or manual pushing as the prime mover, and be provided e.g. with cable means for being operated as an ordinary cable car; the other — i.e. front — end of the railway comprising an abutment having a cushioned impact-receiving surface complementary to the correspondingly cushioned front face of the car, with automatic electric power cut-off means for the stationary motor (in case such were to be used, as distinguished e.g. from mere human pushing power). Also, provision for push-button return of the cable car to its starting position — whether by electrical energy or mere pulling of the cable — would easily be supplied. Further included in the concept was the idea that the midget diver-passenger would be projected by merely his own momentum out over the pool water, and notwithstanding abrupt blocking of the forward movement of the car by the abutment; the pitch of the railway to be optionally variable from any desired upward angle (in case high-energy high diving were to be effected) to horizontal or any desired degree of downwardly sloping angle. Further, the front portion of the top of the car would comprise a diver exit surface set at any desired angle, independently of that of the railway or the top of the car, per se; and the body of the car would advantageously either be hollow or contain lightweight rigid foam such e.g. as Styrofoam, polyurethane, polyvinyl chloride, polyethylene, nylon or the like, so as to lessen the impact force of the car against the abutment and yet be of any desired degree of durability.

Employment of midgets such as aforesaid, it seems clear, would have numerous highly significant advantages over the human divers employed in said University researches, as well as over wooden blocks, mannequins, monkeys and cadavers — all of which received casual non-particularized mention as of possible utility for the purpose at hand, yet were apparently not used or used very little, or else were ruled out before being used at all.

More especially, the unique advantages of the midgets of the invention would include the fact that they would normally be made up in quantity lots, so that each would be identical to each of the others — in other words, they would be identical twins, triplets, quadruplets, quintuplets, and so on; by virtue of which only a single individual factor or physical attribute might be varied from one research experiment to another, or a single permutation or combination be thus varied; or, instead of that, a single factor such as speed, length or angle of railway, pitch of exit surface at the top front of the car, depth of miniature pool (e.g. an aquarium only a few feet in length, a foot or a foot and a half in width, and say 18 or 20 inches high) placed on an expansive table in the engineer's private office where the test dives could readily be programmed, observed, and photographed, and explicit data made of all pertinent circumstances fully recorded; the entire procedure being accomplished in far greater fullness and thoroughness, and far less time, than was at all possible in the aforesaid life-size diving researches; as well — and of course most importantly of all — as without any risk at all to the well-being of an animate diver; the only occasion for use of mathematical models being to translate all the data from the dimensional scales of the midgets to whatever life-size scales might be in mind. Thus, a midget 12 inches long, 2 inches broad at the hips, 1 inch thick at the midriff, with shoulders only a little wider than the hips, and weighing 1 pound — the weight and center-of-gravity-location, as mentioned above, being accomplished by wrapping of appropriately-sized thin (e.g. 1/16 inch thick) lead sheeting about the trunks of the midgets, and/or taping patches of such sheeting to selected body areas — would become, if "blown up" e.g. to a 5/1 degree, enlarged as follows: 12 inches to 5 feet in height; 2 inches to 10 inches in breadth at the hips; 1 inch to 5 inches in thickness at the midriff; 2(+) inches to perhaps 11–14 or more inches across the shoulders; and 1 lb. (5×5×5× or) 125 lbs. in weight.

Illustrative application of the foregoing research procedure could be made in ascertaining the dimensions, both area-wise and depth-wise, of the novel safety flooring to be described below, or the length of the novel non-slip (or low-slip) safety covering for upper portions of slides as discussed below, as well as structural details to be desired for the novel safety-brace-for-slide-divers also discussed below.

Further points of interest in regard to life-size living versions of the midgets include the elimination (via optional horizontal arrangement of the railway on the pool deck) of danger of accidental falls from upper portions of the slides or their ladders; while further points of interest in regard to use of the inanimate midgets in reduced scales include the extreme automatic mechanical precision attainable with them, their cable cars and their railways, plus reducing or eliminating need for indulging hypothetical speculation or postulation, as well as debatable analysis in interpreting experimental results.

In the drawings, wherein all figures are to be understood as basically diagrammatic or schematic, and all expressions such as horizontal, upward, front, rear, etc., as being relative and approximate unless otherwise evident, to be more particularly described later on:

FIG. 1 is a schematic plan view (drawn to a scale of 3/16 inch to 1 foot) of a cable car railway extending from a location on the deck of a pool (a portion of which is broken away) to an abutment fronting directly over, and at right angles to an edge of the pool (said edge extending at right angles from the shallow end of the pool), plus a safety floor disposed for being impacted by adult or large teenage divers (i.e. persons who might suffer injury from unanticipated "crab-catching" in their dives) via fall-breaking fracturability of the safety floor;

FIG. 2 is a right-side view of the submerged well appearing in FIG. 1 (except that the right side of the wall and overlying water have beem omitted) showing peripheral support and retainer structure for holding the floor in place; the floor itself being of rigid (but ribbed) flexible lightweight foam, such e.g. as (but in no way limited to) Styrofoam having a bulk density on the order of 1 to 3 pounds per cu. ft.; and sustaining strips of sheet lead (coated with or encased in water-inert material) in its upwardly exposed valleys, for countering up-bowing by buoyance of underlying water;

Figure 1:
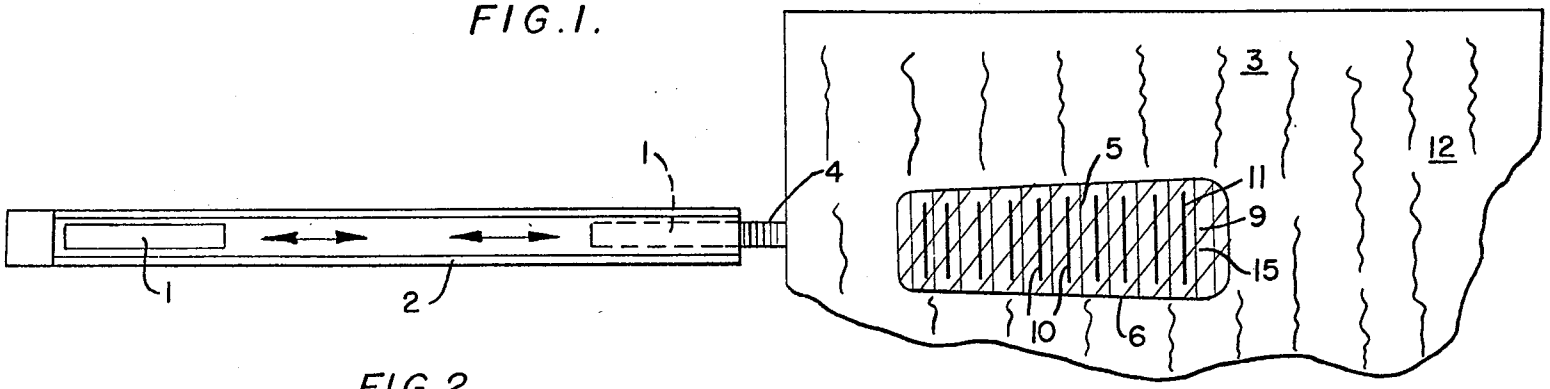
Figure 4:
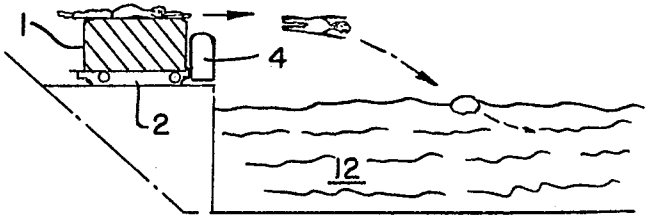
FIG. 4 is a fragmented detail showing the cable car of FIG. 1 in juxtaposition to the abutment thereof, as well as a diver lying prone on the top of the car in position to be projected both forwardly and, due to gravity, downwardly into the water.
Figure 6:
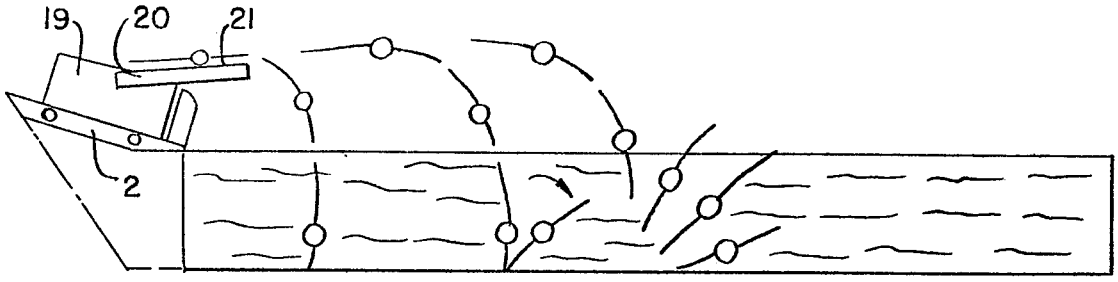
Figure 7:
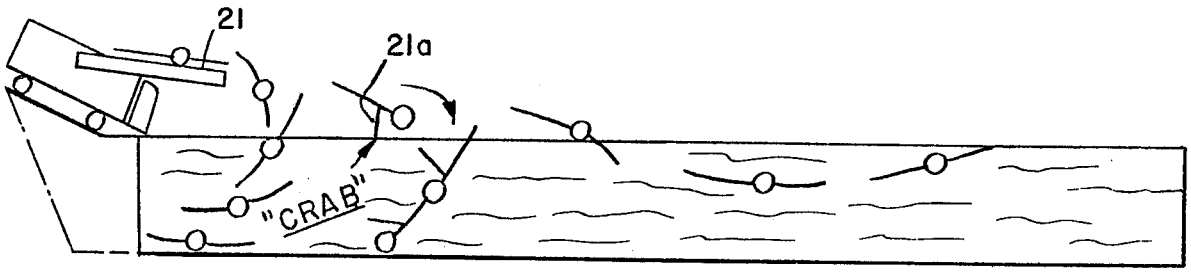
Figure 8:
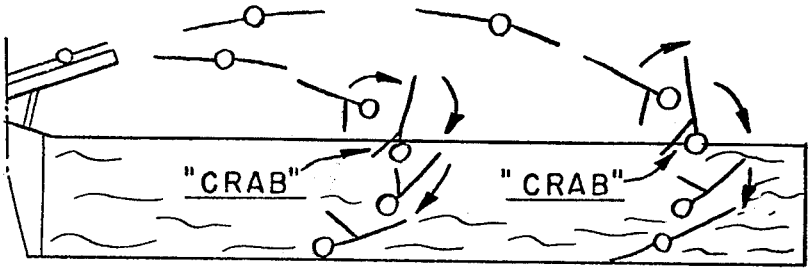
Figure 9:
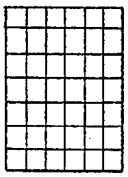
Figure 10:
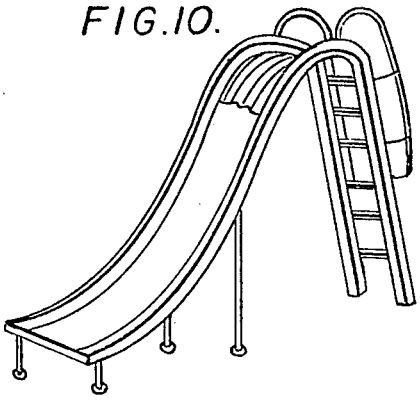
Figure 11:
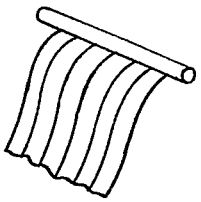

FIG. 6 is a schematic right-side elevation of the pool of FIG. 1 except with its railway pitched at a shallow angle downward and with a variation of the cable car of FIG. 4 in impacting juxtaposition to the abutment of FIG. 4; an upwardly pitched diver-exit platform being mounted on the forward portion of the car and a variety of postulated diver trajectories whose manner of precise production or re-production would be, it is believed, of research interest to the swimming pool industry generally — particularly from the standpoint of ascertaining reliable criteria for preventing pool bottom-impacting such as evidenced in the figure;

FIG. 7 is similar to FIG. 6 except that the first diver is performing a premeditatedly extremely slow and utterly innocuous rotational descent, while the second diver has inadvertently "caught a crab," thereby converting his speed and momentum (manifestly far greater than that of the first diver) into viciously violent downward somersaulting terminated by a sledgehammer-to-anvil-like collision of his head with the concrete pool bottom; the trajectory of the third diver, in contrast to those of the first two, being devoid even of any trace or even semblance of danger by virtue of the substantially horizontal, relatively elevated terminal portion of its trajectory;

FIG. 8 is a similar to FIG. 7 except that the diver-exit portion of its car is pitched at a sharper angle upward than that of FIG. 7, and each of its divers has acquired extra speed and momentum — this being spectacularly so in the case of the second diver — so that both of them are about (notwithstanding the wholly safe angularity of the air portions of their journeys until then, as well as with total absence of warning) to become instantaneous candidates for life-long quadriplegia (within about 1/100th of a second);

FIG. 9 is a schematic view of a safety chart from which a prospective slider can, by knowing his own weight and height, read directly the length of the about-to-be-discussed slip-resistant slide covering which, when applied to an upper portion of the slide, will retard his initial acceleration to the precise degree requisite for assuring him complete safety from any collision with the pool bottom; the contemplation being that the data which determined said length, and from which any other particular length would be similarly determinable, are based on dependable statistics;

FIG. 10 is a front perspective of the Aqua-Slide — N — Dive slide on which a length of covering such as mentioned in the preceding paragraph has been installed;

FIG. 11 is a front perspective, looking down, of a fragmented covering of FIG. 10 which illustrates the extreme simplicity thereof, and its installability and removability;

FIG. 12 is an exploded plan view of a miniature inanimate diver fashioned from a length of pine wood containing slanting notches in a frontward portion, the location on the latter being similar to that of the shoulder joints of a human body, and said wood being so weighted with pieces of thin lead sheeting as to place its center of gravity in the same location along its length as that of a human diver; the two elongated but shorter lengths of the same wood at the top of the figure representing rigid arms presently to be discussed;

FIG. 13 is a bottom view of the lower portion of FIG. 12;

FIG. 14 is the same as FIG. 12 except that the aforesaid "arms" have been annexed to the structure shown directly beneath them in FIG. 12, and then secured by rubber bands — thereby simulating human arms in straight-ahead posture;

FIG. 15 is a side elevation of said body with the arms wedge-fitted into the slots appearing in each of FIGS. 12–14;

FIG. 16 is a front view of a resiliently flexible diving doll whose length is about 11½ inches and whose weight and center of gravity have been appropriately adjusted by engirthing its trunk with a waistband of sheet lead 1/16 inch thick;

FIG. 17 is the doll of FIG. 16 except with stiff lengths of pine wood securely annexed to its upstretched arms and secured in that posture by adhesive tape enveloping the upper chest and armpits of the doll;

FIG. 18 is a side view of the doll of FIGS. 16–17 but with its arms held in an outstretched position corresponding to that of the arms in FIG. 15;

FIG. 19 is a fragmentary front view of the trunk portion of the doll of FIGS. 16–18 with the aforesaid lead waistband secured in place by waterproof adhesive tape;

feet 9 inches; 20 is a plan view of a buoyant safety brace for pool sliders to wear underneath the upper portions of their trunk and underportions of their arms, by reclining thereon — the brace itself having been placed on the top portion of the slide (understood); the pivoted arm-upholders in the upper portion of the figure being yieldably held in inwardly slanting positions by an elastic band, so that with the diver's outstretched arms resting on said upholders he can, by exerting a slight outward pressure against the side walls of the upholders, spread them into the dash-line positions shown in the figure and later, after penetrating the water, cause said elastic bands to pull the arms back into their former positions by merely raising of his arms slightly, thereby releasing them and providing ample freedom for their use in swimming; it being contemplated that by simply placing his prone body in position on the brace and buckling the belt shown in the figure, the driver can, if he be an adult, be absolutely safe from head injury in water depth even as low as 2 feet 9 inches; or, if he be a non-swimmer using a slide leading into an unlimited depth of water, be absolutely safe from drowning;

FIG. 21 is a side view of a diver using the safety brace of FIG. 20 in the aforesaid manner (the lower portions of his legs as well as of the slide itself being omitted from the drawing);

FIG. 22 is a fragmentary plan detail of the left arm-upholder of FIG. 20 with the left arm of a diver resting on its support surface; and FIG. 23 is a cross-sectional detail of the arm-upholder and arm of FIG. 22

Figure 2:
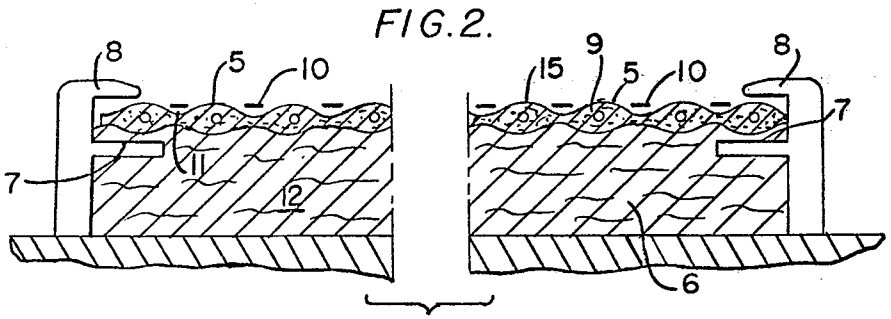
Figure 3:
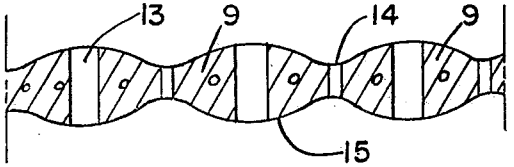
FIG. 3 is a still further enlarged cross-sectional detail of the safety floor of FIG. 2, the lead strips being omitted to emphasize the vertical holes in the floor for permitting egress of the water beneath, in the event of impact from a diver, followed by its re-ingress forthwith.

Referring to the drawings in detail:

In FIGS. 1–3 the cooperation of the cable car 1, railway 2, pool 3, abutment 4, safety floor 5, well 6, peripheral support 7, retainer structure 8, foam 9, strips of lead 10 resting in valleys 11 (said strips of lead being illustrative of use of such weighting material in the form of discrete pieces) and water 12, plus large holes 13 and small holes 14, has already been described. But it should be added that the vertical thickness of the valleys 11 optionally would be sufficiently small to ensure fracture in one or more of them, in the event of downward collision with said floor 5 by the head or other body part of a diver whose static weight is, say, 100–125 pounds; yet of sufficient strength — e.g. if about ⅜ inch thick — to sustain not only the very slight pressure which would be exerted on the floor by the feet of wading juveniles (taking into account the near-equality between their specific gravities and their of the water, which results in buoyant supporting of the floor almost sufficient to offset the pressure of the waders' feet). And the pre-teenagers would likely weigh so little that their low momentum (with resultant quick sinking) would require no provision against downward impacting of the safety floor 5 by their bodies, when projected from the cable car exit. Further, should the left-hand wall appearing in FIG. 1 be close enough to the left wall of the well 6 for pre-teenagers or others to jump from the former to the latter — and should they then descend into contact with the floor — the extra thickness of the ribs 15 will easily be ample to obviate resulting fracture of the floor.

Installation into the position of use shown in FIG. 2 can be readily accomplished, of course, when the pool and well are empty; with peripheral feeding-into-place between overlying retainer structure 8 and support 7 aided by flexibility of the foam.

No numeralizing of the parts of FIG. 4 appears needed, in view of the particularized description of their analogs already given.

Figure 5:
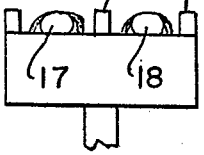
FIG. 5 is a detail sketch of the front of a cable car such as that of FIG. 4 except wider, and provided with a trio of mutually parallel partitions defining a pair of support surfaces and exits for twin divers.

The same appears to be the case with respect to FIG. 5, except for assigning the number 16 to the partitions appearing therein and the numbers 17 and 18 to the heads of the twin divers (otherwise not numeralized) flanked by them.

With regard to FIG. 6, the downward pitching of its railway 2 and cable car 19 facilitates generation of speed during use, such speed being given a slightly upward direction by the angulation of the diver-exit platform 21.

In considering the behavior of the divers in FIG. 6, as well as the other diver-containing figures, it will be recalled that the divers may be full-grown persons, ranging e.g. from 3 feet in height to 7½ or 8 feet or more; or they may be midget-sized facsimilies of human beings as far as the physics of their behavior is concerned. That means that the disclosure, in all its aspects, is believed applicable, on the one hand, to recreational use of the invention's apparatus and method wherever pools of suitable size and depth are to be found; or, on the other hand, to research apparatus of a sufficiently reduced scale e.g. to comprise an aquarium only a yard long, a foot wide and 1½ feet in height; with other parts, including midget facsimilies of humans, as aforesaid, in proportion. In fact, toy-sized swimming dolls marketed in and around Washington, D.C., at least in recent months, via domestic merchandising companies' importing of them in packages marked "Made in Hong Kong" together with miniature cable cars fashioned from diminutive toy truck chassis, with the upper portions of cable cars 1 installed on them, have been marked "Made in Japan;" the drawings of FIGS. 1 and 4–8 herein each comprising swimming dolls and toy truck chassis and wheels thus marked. The prime mover in such cases has been merely manual urging by the applicant, i.e. in lieu of the stationary motor (unnumbered) depicted by the rectangle at the left end of railway 2 in FIG. 1.

As regards the dolls in particular, it is to be observed that their texture seems very humanlike, and their body configurations remarkably graceful and correct; also, their heads are swiveled so that when the feminine dolls are placed in diving posture on the cars, their backs can serve as stomachs, thereby making suitably flat and stable contact with the top of the car easier than otherwise — the consequent upwardly-pointing posture of their feet being of no consequence. Additionally, most — though not all — of the dolls which were comprised in the apparatus from which the drawings were made, were also jointed, or swivel-jointed, at the shoulders, or the elbows and wrists too, as well as at the hips; or also at the knees and ankles, besides being sufficiently frictionized in the joints that when assuming a particular posture, responsive to manual urging, they retained that posture until subsequent such urging.

In order to bring the densities of the dolls sufficiently close to that of water for good performance, pieces of thin sheet lead were form-fitted like waistbands around their midriffs, with the locating of the bands adjusted so as to place their centers of gravity one-third the distance from the crotch to the chin. And for purposes of immobilizing their arms when extended straight ahead or dangled downward, pieces of pine wood 4 inches long, ⅜ inch wide, and ⅛ inch thick were employed; rubber-banding of them about the wrists and near the shoulders serving to immobilize them in the rigidified state i.e. when supplemented by waterproof adhesive tape applied over their shoulders and around their backs.

An illustrative research observation that seemed of particular interest was that when no rubber banding of the wooden pieces to the arms was effected other than at the wrists, the "crab-catching" phenomenon did not precipitate a somersault. This seems to have been because the arms were hanging limp rather than tensed-up or rigid, so that the water into which they penetrated in effect pushed the arms rearward.

Perhaps the most striking utility of the driving dolls is the identicalness of one to the other, or to any number of the others, whereby use of one as a control and another to embody merely a single difference in structure, or in a particular combination of structurel parts and proportions — with no change whatever in other respects — pointed the way to precise pinpointing of the significance of an unlimited number of variables involved or potentially involved in diving behavior — all without any need, whatever, of exposing any human diver to risk or injury. And especially is this true when considered in the light of the extremely extensive tests of diving maneuvers in the large pool complexes mentioned above wherein, it has been reported, one and the same diver in a long succession of tests intended to be as nearly identical, one to the other, as possible, has evidenced consistent and substantial differences throughout, i.e. from any one of such succession of tests to another.

It will have been noticed that in each of the dives depicted in FIG. 6, the diver's body made a streamlined penetration of the water, and because of that could be viewed as involving merely an ordinary sort of dive which resulted in collision with the pool bottom only because the water depth was inadequate.

In enormous contrast with that situation, it will be noted that only the first dive in FIG. 7 was in said category, and that the second dive involved inadvertent downward dangling of the diver's arms 21 which savagely, and with almost the speed of light, so to speak, converted his nearly horizontal high speed and momentum into a vertically downward reverse roll which banged his head abruptly against the pool bottom at a point just about vertically below the point of said penetration.

Inspection of each of the dives depicted in FIG. 8 will show, without further numeralization, that the same phenomenon occurred — i.e. violently instantaneous transformation of a "Dr. Jekyll" diver faithfully keeping his air path well within the optimum safety range, as regards the angle of water entry, until — owing solely to inadvertence in respect to the posture of the arms, no matter what the reason for the inadvertence may have been, and taking into account that many of the possible reasons may have been such as would be regarded as entirely excusable by members of an ordinary jury — into a "Mr. Hyde" diver.

The safety chart of FIGS. 9-11, together with its placement and manner of installation or removal, has already been fully discussed hereinabove.

The same is believed true in respect to the miniature diver of FIGS. 12–15, unless to mention that dots 22 represent heads of nails which were used to secure the lead sheeting 23 and 24 in position; or also to point out that in FIGS. 13 and 15 side rails 25 serve to keep the diver's body in stable position when lying prone on the top of a cable car such as 1, in FIG. 1.

The significance of each of the parts in FIGS. 16–19, as well as their manner of functioning, is believed to be readily apparent from the description of them already presented hereinabove.

In FIGS. 20–23, the hereinabove described parts may be helpfully numeralized as follows: the brace 26, the pivoted (at 27) arm-upholders 28, the elastic band 29, the outstretched arms 30, the side walls of the upholders 31, the belt 32, and the buckle 33.

While the belt 32 (FIGS. 20–21) is shown by fastened by the buckle 33 overlying the back of the diver after he has reclined onto the brace, it of course could be under his belly instead, so as to be easily unfastened as soon after water entry as he might wish; the buoyance of the brace resulting from use of Styrofoam or the like for its rigid members thereby preventing it from sinking out of sight or out of retrieving reach.

Again referring to the non-slip safety covering mentioned in the above descriptions of FIGS. 9–11, it will be apparent that any of a wide variety of thin rubber mattings, e.g. such as used for floor-covering on front floors of automobiles, will be suitable, as also will thin, paper-like but durable fine-granular exposed surfaces, e.g. very fine-grained waterproof sandpaper.

The designation "CRAB" on FIGS. 7 and 8 results from the statement in col. 2 (lower) on page 665 of the Encyclopedia Brittanica article on "Rowing" (1973 edition), that when an oarsman "catches a crab" it is because "his blade is caught in the water," in consequence of which it "*dives*" (emphasis added). It also is common knowledge that the force generated in such case often is so violent that not only is the oarsman thrown bodily up and outward, so that he lands clear of the shell with the latter being overturned in the process as well, but his fellow crew mates often are "dunked" also. But even more graphic is the behavior of the horizontally-pivoted planes or vanes near the fronts of fleet-type submarines such as were used in WW II, since they are positioned in precisely analogous manner to that of the aforesaid downward-dangling arms of the divers in FIGS. 7 and 8. I.e., rotation of said planes into postures precisely corresponding to those of said arms serves to instantly throw the submarine into a downward dive, notwithstanding the immense size and weight of the submarine; the disparity in the overall size of the submarine as compared with the relatively minute size of said front diving planes being quite astonishingly exemplified at the right of the diagrammatic view of the submarine shown on page 246 of Chambers's Technical Encyclopedia (1966), Volume XIII, wherein the word "HYDROPLANE" and its lead line designate corresponding horizontally pivoted diving planes on the immense British submarine appearing in the diagram. I.e., by applicant's measurement on the diagram, said front diving planes are only ⅛ inch in length, while the overall length of the submarine itself is 5 1/16 inches on the diagram!

Further articles of special interest in the present regard are to be found in Volume 21 of Collier's Encyclopedia (1974), page 581, col. 2, wherein "horizontal vanes" such as aforesaid are referred to as having been used by the pioneer American inventor, Simon Lake, in the last century; also, col. 1 on page 819 of the Encyclopedia Americana (1975 edition), Volume 25, wherein the instant use of "horizontal ... diving planes" also is referred to. Additionally, it may be of interest to mention, that United States Naval Training Booklet No. 16160 (1946; revised in 1955), available at the Naval Annex Library in Arlington, Va., contains large-scale prints of such vanes among its 20 pages.

Of still more emphatic interest in the present connection, however, it is the definition of "crash dive" e.g., in Webster's Third New International Dictionary (1967), page 530, col. 3 (lower):

"A dive made by a submarine (as in avoiding attack) in the least possible time (emphasis added)."

In thus graphically evidencing the terrific violence of the mechanical forces triggered by downward posturing of said front diving planes of submarines, the proportionately corresponding violence of the "CRAB" dives in FIGS. 7–8 is also attested.

What is claimed is:

1. In combination
a swimming pool having a deck
a railway having a runway flanked by side walls rising higher than said runway
a car provided with rollers disposed for traveling along said runway between said walls
said railway extending from a starting point distance from said pool toward a point adjacent an edge of said pool
an abutment located at said last-mentioned point and disposed for blocking movement of said car when impacted by it during use
said car having an upward-facing top portion disposed for supporting a diver reclining thereon in belly-down prone position
whereby impacting of said abutment by said car abruptly terminates movement of the latter, thereby permitting momentum acquired by said diver during said travel to propel him outwardly of said edge and over water in the pool.

2. The combination of claim 1 which comprises a stationary motor and wherein said car is a cable car
said motor being disposed to move said car along said runway to a point in advance of but in juxtaposition to said abutment
said motor being provided with automatic means for deactivating it prior to inter-contact between said front of said car and said abutment 3. The combination of claim 2 wherein said motor is an electric motor and said means is an electric switch disposed for being automatically opened prior to such intercontacting 4. The combination of claim 1 wherein said car comprises a frame and rigid polymeric foam contained within said frame, said foam serving to strengthen said frame against stress caused by intercontacting of said car with said abutment 5. The combination of claim 4 wherein said polymeric foam comprises a polymer selected from the class of polystyrene, polyurethane, polyvinyl chloride, and nylon.

6. In combination
a swimming pool having a deck
a runway overlying said deck and terminating at an abutment located adjacent to said pool
a car for traveling along said runway toward said abutment
said abutment being disposed to block such traveling when contacted by said car
said car having an upward-facing top portion disposed for supporting a diver reclining thereon in belly-down prone position with his arms optionally extending either directly frontward or at any desired downward degree in outside juxtaposition to the sides of said car
the front of said top portion being higher at the instant of such blocking than the top of said abutment
the length of said car exceeding the height of said car, said height exceeding the width of said car, and said width at least equalling the width of said abutment
whereby momentum acquired by said diver during said travelling propels him freely past said abutment and out over water in said pool, irrespective of whether or not his arms were extending at a desired downward degree as aforesaid 7. The combination of claim 6 which comprises a stationary motor and wherein said car is a cable car
said motor being disposed to move said car along said runway to a point in juxtaposition to said abutment, and
said motor being provided with automatic means for deactivating it prior to inter-contact between said front of said car and said abutment 8. The combination of claim 7 wherein said motor is an electric motor and said means is an electric switch disposed for being automatically opened prior to such inter-contacting 9. The combination of claim 8 wherein said car comprises a frame and rigid polymeric foam contained within said frame, said foam serving to strengthen said frame against stress caused by such aforesaid blocking 10. The combination of claim 9 wherein said polymeric foam comprises a polymer selected from the class of polystyrene, polyurethane, polyvinyl chloride, and nylon.

* * * * *

UNITED STATES PATENT OFFICE

CERTIFICATE OF CORRECTION

PATENT NO. : 4,030,147

DATED : June 21, 1977

INVENTOR(S) : Harold A. Jewett

It is certified that error appears in the above-identified patent and that said Letters Patent are hereby corrected as shown below:

Column 1, line 17, "linear" should be: --liner--.

Column 5, line 20, "feet 9 inches;" should be: --FIG.--.

Column 6, line 1, "their" second occurrence should be: -- that --

Column 7, line 32, "driving" should be: --diving--.

Column 8, line 30, "by" should be: --as--.

Column 9, line 44, "distance" should be: --distant--.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*